US006206095B1

(12) United States Patent
Baugh

(10) Patent No.: US 6,206,095 B1
(45) Date of Patent: Mar. 27, 2001

(54) APPARATUS FOR DROPPING ARTICLES DOWNHOLE

(75) Inventor: John L. Baugh, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/332,233

(22) Filed: Jun. 14, 1999

(51) Int. Cl.[7] ..... E21B 33/05
(52) U.S. Cl. ..... 166/70; 166/291; 221/263
(58) Field of Search ..... 166/70, 75.15; 221/263, 264, 265, 266

(56) References Cited

U.S. PATENT DOCUMENTS

| | | | | |
|---|---|---|---|---|
| 2,713,909 | | 7/1955 | Baker | 166/70 |
| 3,396,789 | | 8/1968 | Dean | 248/245 |
| 3,403,729 | * | 10/1968 | Hicky | 166/75.15 |
| 3,785,525 | * | 1/1974 | Handeland | 221/265 |
| 4,317,486 | | 3/1982 | Harris | 166/250 |
| 4,354,278 | | 10/1982 | Clark et al. | 455/617 |
| 4,427,065 | | 1/1984 | Watson | 166/250 |
| 4,468,762 | | 8/1984 | Jurgens | 367/83 |
| 4,671,353 | | 6/1987 | Daming | 166/70 |
| 4,721,158 | | 1/1988 | Merritt, Jr. et al. | 166/250.01 |
| 4,767,280 | | 8/1988 | Markuson et al. | 166/66 |
| 4,782,894 | | 11/1988 | LaFleur | 166/70 |
| 4,785,880 | * | 11/1988 | Ashton | 166/53 |
| 4,854,383 | | 8/1989 | Arnold et al. | 166/70 |
| 4,924,482 | | 5/1990 | Shimizu et al. | 375/65 |
| 5,033,113 | | 7/1991 | Wang | 359/142 |
| 5,040,603 | | 8/1991 | Baldridge | 166/291 |
| 5,095,988 | | 3/1992 | Bode | 166/291 |
| 5,142,534 | | 8/1992 | Simpson et al. | 370/330 |
| 5,188,178 | * | 2/1993 | Noyes | 166/75.15 |
| 5,191,937 | | 3/1993 | Cook, Sr. | 166/363 |
| 5,279,305 | | 1/1994 | Zimmerman et al. | 600/544 |
| 5,293,933 | | 3/1994 | Brisco | 166/70 |
| 5,383,044 | | 1/1995 | Borchardt et al. | 359/145 |
| 5,435,390 | | 7/1995 | Baugh et al. | 166/285 |
| 5,590,713 | | 1/1997 | Baugh et al. | 166/53 |
| 5,873,139 | | 2/1999 | Goth | 15/104.062 |
| 6,044,905 | * | 4/2000 | Harrison, III | 166/75.15 |
| 6,056,058 | * | 5/2000 | Gonzalez | 166/75.15 |

FOREIGN PATENT DOCUMENTS

| | | |
|---|---|---|
| 249745 | 5/1987 | (EP) . |
| 456397 | 4/1991 | (EP) . |
| 2508095 | 3/1982 | (FR) . |
| 2340861 | 1/2000 | (GB) . |
| 59-044135 | 3/1984 | (JP) . |
| WO 94/28282 | 12/1984 | (WO) . |

OTHER PUBLICATIONS

Baker Service Tools, Model TD Plug Dropping Head Drawing 783–367, May 1990 1 page.

* cited by examiner

*Primary Examiner*—David Bagnell
*Assistant Examiner*—Kamal Dawelbeit
(74) *Attorney, Agent, or Firm*—Duane, Morris & Heckscher LLP

(57) ABSTRACT

A plug-dropping head in which the objects to be dropped are placed in individual discrete passages. A motor-driven or hand-operated rotating member orients an entrance to a passage going through it to, in series, individual passages in the housing for sequential dropping of objects downhole. A relief port is provided so that as the rotating outlet member moves from one passage in the housing to the next, the relief passage allows continuing flow delivered by the surface pump.

17 Claims, 4 Drawing Sheets

APPARATUS FOR DROPPING ARTICLES DOWNHOLE

FIELD OF THE INVENTION

The field of this invention relates to surface-mounted equipment which can be used for dropping articles of various sizes and shapes downhole to facilitate downhole operations.

BACKGROUND OF THE INVENTION

Many downhole operations require sequential dropping of various objects downhole to facilitate a downhole operation. The sequence may involve dropping a ball on a ball seat to close off the wellbore to allow pressure to be built up to actuate tools such as packers or hangers or downhole valves. Cementing operations typically involve dropping one or more wiper plugs in a specific order to, for example, wipe the wellbore clean of the cement. These objects to be dropped downhole are frequently assembled in surface equipment referred to as a plug-dropping head. In the past, plug-dropping heads have been stacked vertically to accommodate the sequential dropping of objects downhole. Thus, the lowermost object would be dropped first and so forth up until the topmost plug-dropping head has released the object stored therein. The problem with this arrangement is that it gets to be quite tall and in most applications, the plug-dropping heads are inaccessible. One way the prior designs have compensated for this inaccessibility problem is to actuate the plug-dropping heads by remote control. Such techniques are described in U.S. Pat. Nos. 5,435,390 and 5,590,713.

One of the objects of the present invention is to provide a compact design which can be operable to insert a plurality of objects downhole within fairly confined vertical space limits at the surface. The object of the device is to present a compact design which can efficiently deliver a series of objects downhole. Another object of the invention is to allow circulation to continue as the device operates to sequentially drop objects downhole. These and other advantages of the present invention will become more apparent to those skilled in the art from a review of the description of the preferred embodiment below.

SUMMARY OF THE INVENTION

A plug-dropping head is disclosed in which the objects to be dropped are placed in individual discrete passages. A motor-driven or hand-operated rotating member orients an entrance to a passage going through it to, in series, individual passages in the housing for sequential dropping of objects downhole. A relief port is provided so that as the rotating outlet member moves from one passage in the housing to the next, the relief passage prevents deadheading of the surface pump.

DETAILED DESCRIPTION OF THE PREFERRED EMBODIMENT

Figure 1:
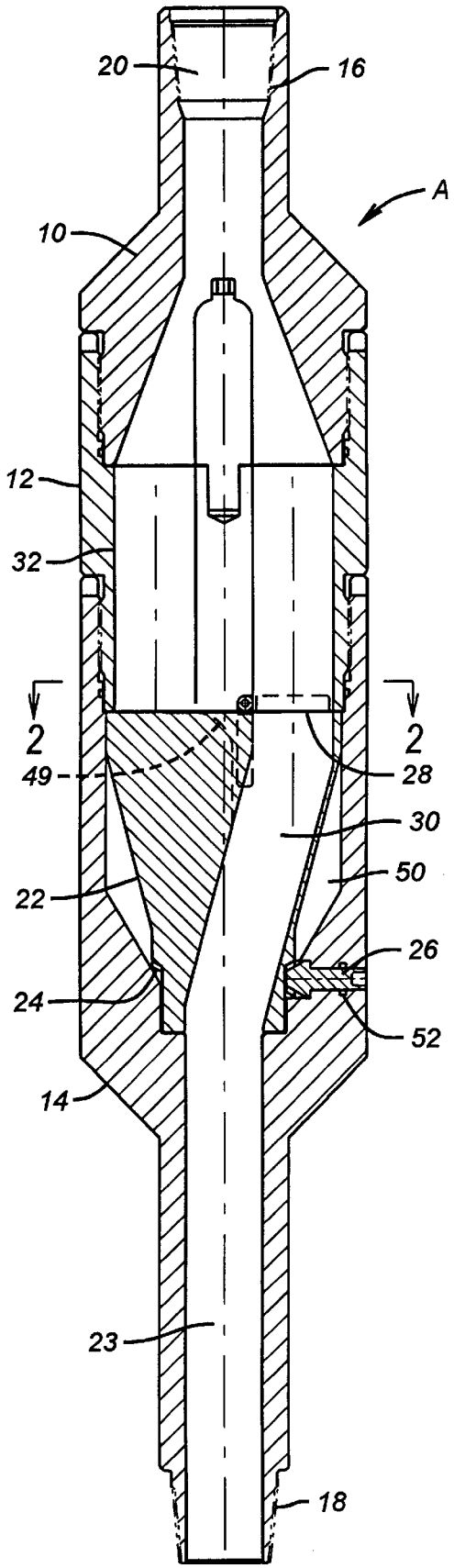
FIG. 1 is a sectional elevational view showing the apparatus in a position where one of the objects is being dropped downhole.

Referring to FIG. 1, the apparatus A has a top sub 10 connected to a body 12. Body 12 is connected to bottom sub 14. These components together comprise the housing. Thread 16 is used to connect the surface pumping equipment (not shown) to the apparatus A. Thread 18 connects the apparatus A to the wellbore. A passage 20 extends through the top sub 10 and ultimately continues as passage 23 in the bottom sub 14. A rotatably mounted outlet device 22 is secured in the bottom sub 14. It has a gear 24 which is driven by a drive schematically shown as 26. Operation of the drive 26 rotates the entrance 28 of a passage 30 which extends through the outlet device 22. Entrance 28 is off-center from the longitudinal axis of body 12.

Figure 3:
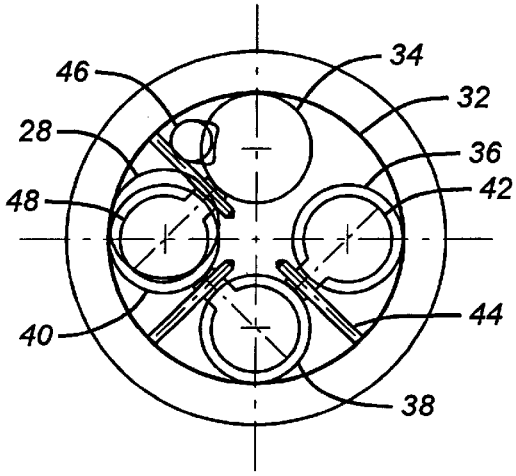
FIG. 3 is the view of FIG. 2, with the outlet member rotated approximately 80° from the position shown in FIG. 2, showing the outlet member arriving close to the position where the next object will be dropped downhole.
Figure 6:
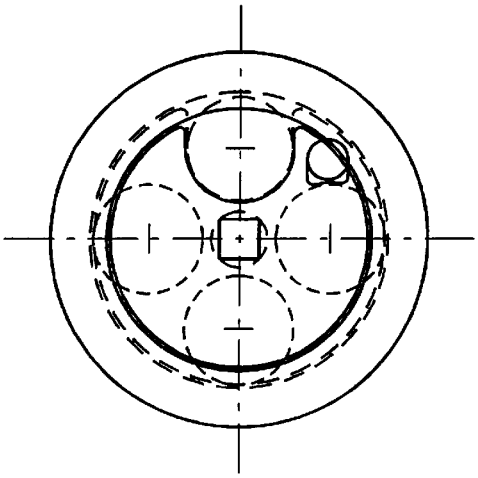
FIG. 6 is a section view along line 6—6 of FIG. 4.
Figure 7:
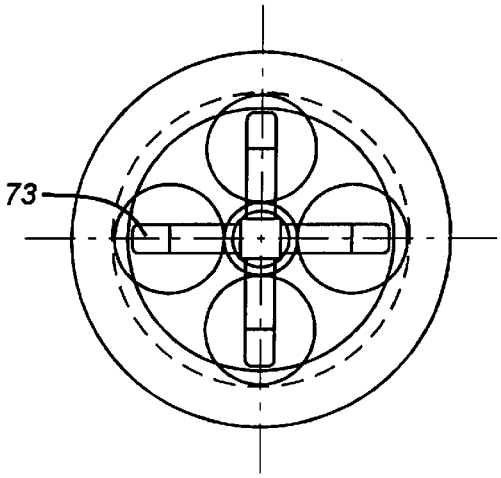
FIG. 7 is a section view along line 7—7 of FIG. 5.
Figure 8:
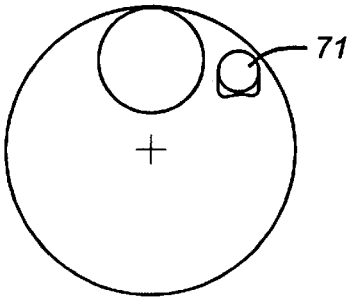
FIG. 8 is a section view through guide 70.
Figure 4:
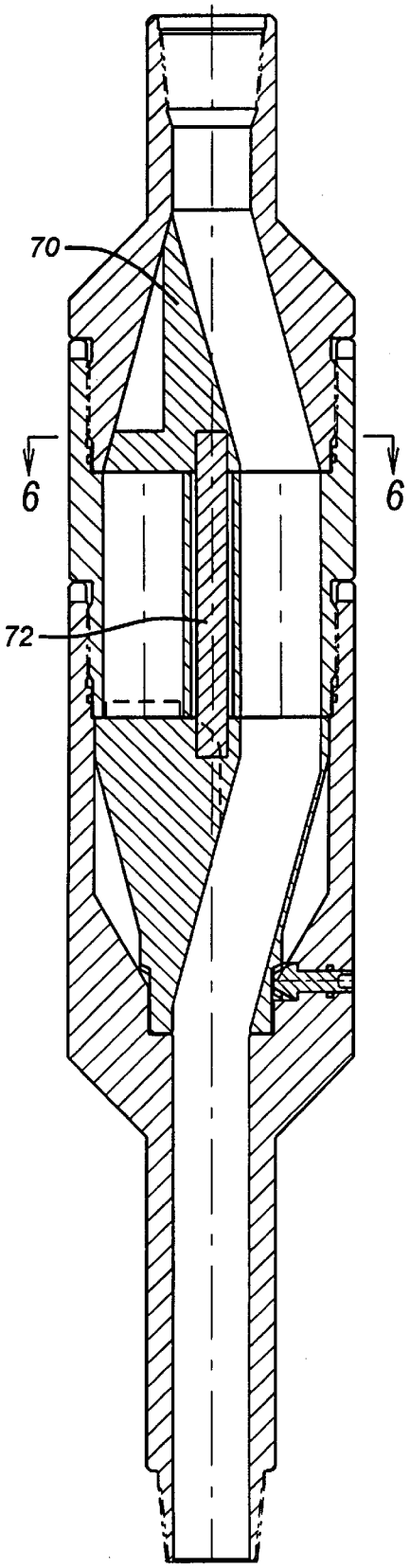
FIG. 4 is a sectional elevational view showing a stackable configuration.

Within body 12 there is a tubular component 32 which defines a series of passages 34, 36, 38 and 40. Those skilled in the art will appreciate that varying the amount or size of these passages is within the spirit of the invention. These passages are illustrated in FIG. 3. Each passage has, internally to it, a flapper or other retaining device 42 which is preferably pivotally mounted on a rod 44. When the entrance 28 of the passage 30 on the outlet device 22 is not in alignment with, for example, passage 36, a solid portion of the outlet device 22 is presented at the base of passage 36, thus preventing the flapper 42 from pivoting about its pivot rod 44. The same is true for the other passages except that the initial passage, which is shown in FIG. 3 as passage 34, does not have a flapper. The apparatus A is configured for the start of operations with the passage 34 in alignment with the entrance 28 to the outlet device 22 with the objects to be dropped downhole positioned in passages 36, 38, and 40, as an example.

Figure 2:
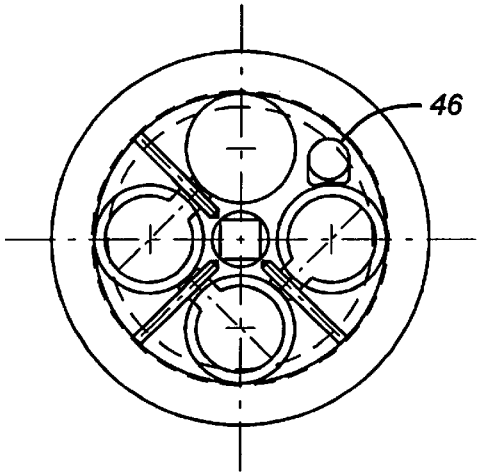
FIG. 2 is a section view along lines 2—2 of FIG. 1.

Another feature of the tubular component 32 is relief passage 46. FIG. 3 illustrates that passage 46 still overlaps passage 34 as the entrance 28 approaches alignment with passage 40. Thus, the flow from the surface pumping equipment can still go through passage 46, through passage 34, until the flapper 48 can swing open when entrance 28 is fully in alignment with passage 40, as shown in FIG. 2. The object in passage 40 can be dropped through the outlet device 22. At this point in time, the passage 46 in the position shown in FIG. 2 is fully obstructed as it is aligned with the solid portion of the tubular component 32 between passages 34 and 40.

As shown in FIG. 1, a curved component 49 in entrance 28, upon further counterclockwise rotation of the outlet device 22, will engage the flapper that is in the downward position shown in FIG. 1 and force it upwardly to the position also shown in FIG. 1 in the course of rotation of the outlet device 22. While a curved component 49 is preferred, other shapes can be used without departing from the spirit of the invention.

Figure 5:
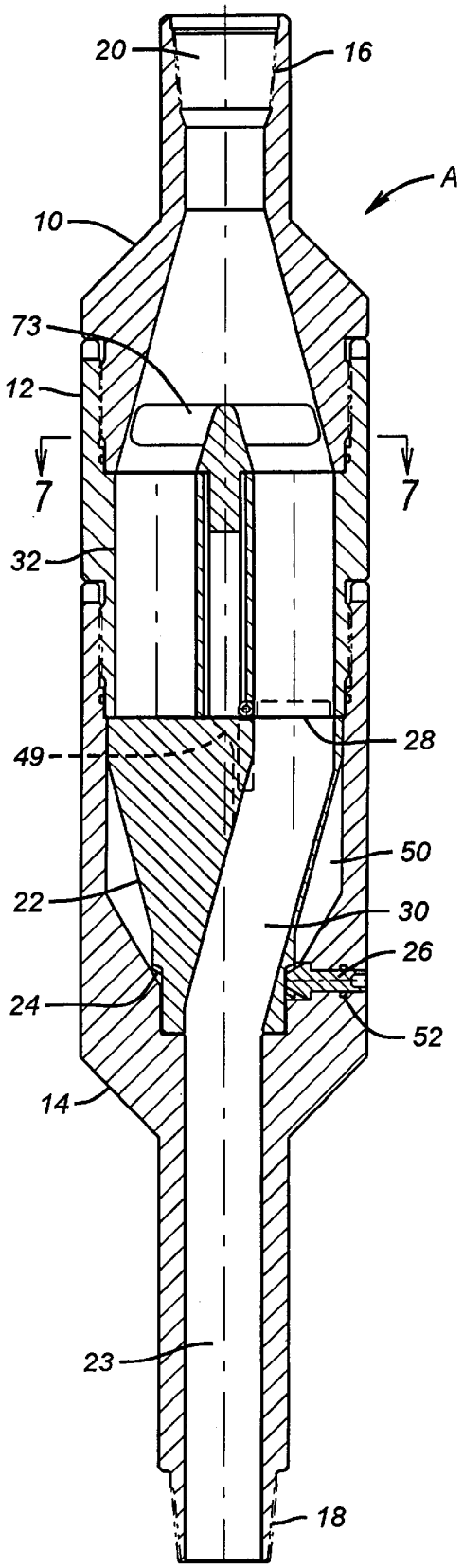
FIG. 5 is a topmost unit for a stackable configuration showing a spider 73 to stop reverse movement in an upflow situation.
Figure 9:
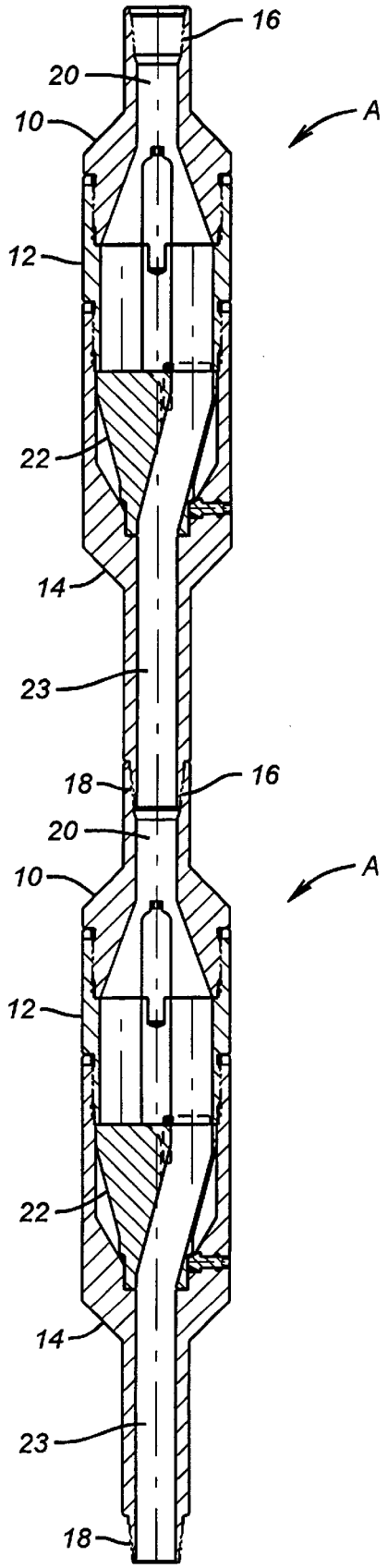
FIG. 9 is a section view showing a stacked arrangement of the apparatus.

The apparatus A shown in FIG. 1 can be operated in stacks as long as the lowermost units are aligned for flow-through. The dropping of objects can begin from the uppermost unit and proceed down to the lowermost unit, or vice versa. When being used as a flow-through unit, a guide 70 is rotated with outlet device 22 to provide a smooth fluid transition from flowpath 20 to outlet device 22. This will allow alternate operation of the stacked plug-dropping heads. Plugs may be dropped in any sequence, regardless of the number of heads stacked. This will allow the sequence to be changed without reloading or stopping circulation. The bottom of guide 70 shown in FIG. 5 also includes passage 71, which functions like passage 46. A drive shaft 72 transmits torque from outlet device 22 to guide 70. The base of guide 70 also covers the top of bores 36, 38, and 40 to prevent possible damage or movement from unexpected flow events.

The top plug-dropping head will have a spider 73 to block upward exit of any of the balls, plugs, or other devices in case of reverse flow, planned or otherwise.

Any number of parallel passages can be provided in tubular component 32 depending on the space or weight limitations applicable.

It should be noted that there are no seals between the outlet device 22 and cavity 50 in the bottom sub 14 in which it is disposed. The only seals necessary are 52, which seal around the drive 26 shown schematically in FIG. 1.

Accordingly, the apparatus A is easy to fabricate and operates reliably to drop in sequence a multiplicity of objects downhole. The drive is simple and the sealing requirements are minimal, thus ensuring low maintenance for the apparatus A.

Additional performance enhancements can be added, such as remote operation, as well as some sort of flag device which indicates the position of the outlet device 22 with respect to the passages in the tubular component 32.

The foregoing disclosure and description of the invention are illustrative and explanatory thereof, and various changes in the size, shape and materials, as well as in the details of the illustrated construction, may be made without departing from the spirit of the invention.

What is claimed is:

1. An apparatus for dropping at least one object downhole, comprising:

at least one housing defining a plurality of passages;

at lease one rotatably mounted outlet member having a passage thereon selectively movable into alignment with said passages in said housing so as to allow an object in a passage in said housing to drop.

2. The apparatus of claim 1, further comprising:

a relief passage in said outlet member positioned to allow fluid flow through one passage in said housing until an object is dropped through an adjacent passage in said housing by virtue of rotation of said outlet member.

3. The apparatus of claim 2, further comprising:

a retaining member in at least one of said passages in said housing to selectively hold an object to be dropped;

said retaining member movable to a drop position by rotation of said outlet member.

4. The apparatus of claim 3, wherein:

said retaining member is movable to a closed position by rotation of said outlet member.

5. The apparatus of claim 3, wherein:

said retaining member comprises a pivotally mounted valve member which can move into said passage in said outlet member when said passage in said outlet member is placed in substantial alignment with said passage in said housing where said valve member is mounted.

6. The apparatus of claim 1, further comprising:

said outlet member having a longitudinal axis and said housing having a common longitudinal axis, said passage in said outlet member having an entrance offset from said axis whereupon rotation of said outlet member, said entrance aligns with different passages in said housing.

7. The apparatus of claim 6, wherein:

said housing comprises at least one unobstructed passage;

said remaining passages in said housing each further comprise a retaining member to selectively hold an object to be dropped.

8. The apparatus of claim 7, wherein:

rotation of said outlet member actuates said retaining member between an open and closed position.

9. The apparatus of claim 8, wherein:

said retaining member is actuated toward a closed position by contact with said outlet member.

10. The apparatus of claim 8, further comprising:

a relief passage in said outlet member positioned to allow fluid flow through one passage in said housing until an object is dropped through an adjacent passage in said housing by virtue of rotation of said outlet member.

11. The apparatus of claim 10, wherein:

each said retaining member further comprises a pivotally mounted plate that opens when said entrance in said outlet member is in alignment with said opening in said housing where said plate is mounted.

12. The apparatus of claim 11, further comprising:

said outlet member mounted within said housing;

said outlet member rotated by a drive external to said housing;

said drive sealed at said housing;

said outlet member having no seals internal to said housing.

13. The apparatus of claim 12, further comprising:

a plurality of said housings with outlet members, vertically stacked.

14. The apparatus of claim 1, further comprising:

said outlet member mounted within said housing;

said outlet member rotated by a drive external to said housing;

said drive sealed at said housing;

said outlet member having no seals internal to said housing.

15. The apparatus of claim 1, further comprising:

a plurality of said housings with outlet members, vertically stacked.

16. The apparatus of claim 15, further comprising:

said vertical stack comprises an uppermost unit which further comprises a catch device to prevent an object from escaping said housing if a backflow condition from downhole occurs.

17. The apparatus of claim 1, further comprising:

an inlet member mounted in a spaced relation to said outlet member and movable in tandem therewith, said inlet member having a passage thereon to selectively move into alignment with said passage in said housing in tandem with said passage on said outlet member.

* * * * *